United States Patent [19]

Werner

[11] Patent Number: 4,844,402

[45] Date of Patent: Jul. 4, 1989

[54] FORM FOR A MORTAR CAP

[76] Inventor: Ronald Werner, 12-204 Dell Pl., Stanhope, N.J. 07874

[21] Appl. No.: 214,170

[22] Filed: Jul. 1, 1988

[51] Int. Cl.[4] ..... E01C 19/50; E02D 29/14; E03F 5/02

[52] U.S. Cl. ..... 249/10; 52/20; 52/21; 249/90; 249/157; 249/159; 404/26

[58] Field of Search ..... 249/4, 10, 11, 13, 34, 249/49, 57, 90, 155, 157, 159, 168, 216; 404/4, 26; 52/19–21

[56] References Cited

U.S. PATENT DOCUMENTS

| | | | |
|---|---|---|---|
| 16,161 | 12/1856 | Floyd | 404/26 |
| 689,224 | 12/1901 | Pillsbury | 404/26 |
| 1,076,386 | 10/1913 | O'Day | 404/26 |
| 1,554,833 | 9/1925 | Armstrong | 249/140 |
| 1,639,495 | 8/1927 | Frame | 404/26 |
| 1,948,931 | 2/1934 | Mears | 249/90 |
| 3,063,122 | 11/1962 | Katz | 249/157 |
| 3,263,579 | 8/1966 | Dorris | 404/26 |
| 3,395,884 | 8/1968 | Laukala | 249/216 |
| 3,773,428 | 11/1973 | Bowman | 404/26 |
| 3,930,739 | 1/1976 | Larsson et al. | 404/26 |
| 4,187,648 | 2/1980 | Hahn | 52/21 |
| 4,614,065 | 9/1986 | Papp | 404/26 |
| 4,666,333 | 5/1987 | Armstrong | 404/26 |

FOREIGN PATENT DOCUMENTS

| | | | |
|---|---|---|---|
| 2145444 | 3/1985 | United Kingdom | 404/26 |

*Primary Examiner*—James Housel
*Attorney, Agent, or Firm*—Bernard J. Murphy

[57] ABSTRACT

The mortar cap receives cementitious materials therewithin, such as cement, mortar, and the like, to define a footing for a manhole frame, and has a base frame with a pair of concentric, spaced-apart walls, and an ancillary frame, also with a pair of concentric, spaced-apart walls. The base frame is set within the ancillary frame, and the latter is slidably and vertically displaceable relative to the base frame. The ancillary frame has a plurality of knobs projecting from walls thereof which confront given walls of the base frame, and the given walls of the base frame has a plurality of racks of ribs which confront the knobs. With vertical displacement of the ancillary frame, or a sector of the ancillary frame, the latter is arrestingly held in the displacement due to an interference of the knobs and ribs, and an engagement of the knobs with a pair of the ribs.

7 Claims, 2 Drawing Sheets

FORM FOR A MORTAR CAP

This invention pertains to forms for the receipt therewithin of cementitious materials, such as cement, or mortar, and the like, for forming structures, and in particular to forms for mortar caps in which to form footings, for a manhole frame, which can accommodate a sloped or tilted attitude.

U.S. Pat. No. 3,858,998, issued on Jan. 7, 1975, to Larsson et al, for a Manhole Frame, disclosed a frame of metal construction capable of elevation and tilt. The same employs adjustment screws for raising, lowering and/or inclining the frame. The patented frame is commendable, but to practice the invention it is necessary to replace all existing manhole frames with that disclosed in the patent. It is much to be preferred that there be some way of accommodating existing manhole frames, as there are surely hundreds of thousands in the country, and being able to elevate them, or tilt them. Similarly, the U.S. Pat. No. 3,263,579, issued to J. P. Dorris, on Aug. 2nd, 1966, for a Ring and Cover Construction for Underground Vaults, is specialized. It too employs adjustment screws, and requires that the underground manhole vault or cylindrical wall have anchor inserts cast therein to receive the adjustment screws. Well, again, the multitudes of manhole vaults or cylindrical walls in place have no such anchor inserts cast therein. Too, it would be cost prohibitive to drill them out to fix such anchors therein. Thus it is that there obtains a need for a form for a mortar cap, for defining a footing for a manhole frame, which requires no specialized manhole frames or anchor inserts in the walls of the manhole vault, or the like.

It is an object of this invention to meet the aforesaid need by setting forth a form for a mortar cap, for defining a footing for a frame for a manhole or the like which is not met with the disadvantages of the known, prior art types.

It is particularly an object of this invention to set forth a form for a mortar cap, for receiving cementitious materials therewithin, such as cement, mortar, and the like, to define a footing for a manhole frame, comprising a base frame; said frame having a pair of concentric, spaced-apart walls; and an ancillary frame; said ancillary frame also having a pair of concentric, spaced-apart walls; wherein said base frame is set within said ancillary frame; and said ancillary frame is slidably and vertically displaceable relative to said base frame.

Further objects of this invention, as well as the novel features thereof, will become more apparent by reference to the following description taken in conjunction with the accompanying figures, in which.

Figure 1:
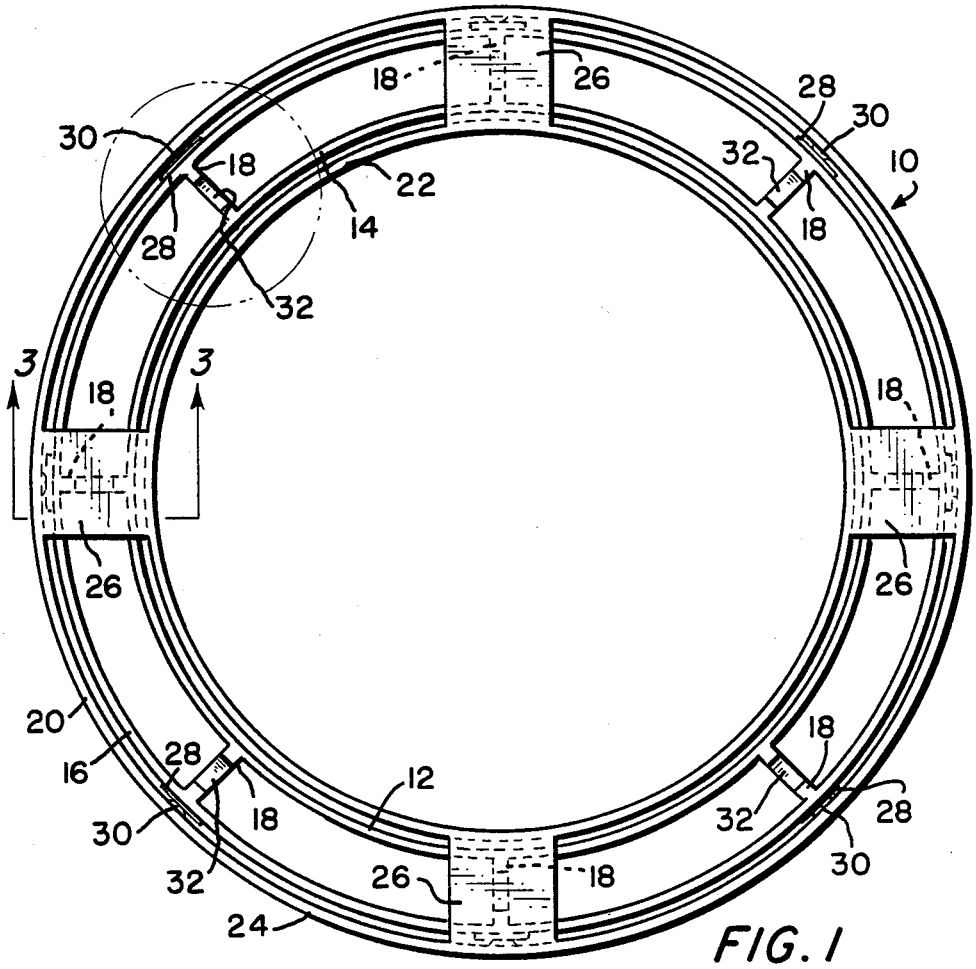
FIG. 1 is a plan view of the novel form, according to an embodiment thereof.
Figure 2:
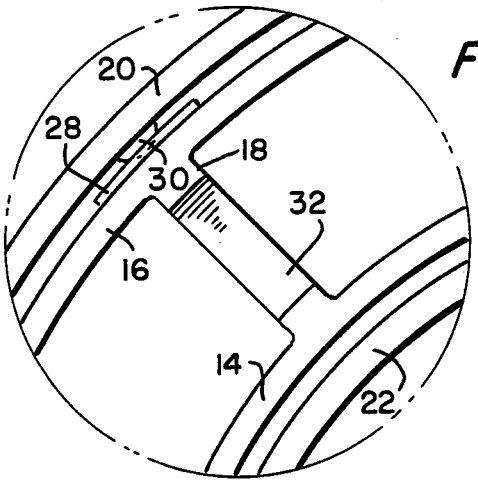
FIG. 2 is an enlarged detail of the area encompassed by the broken-line circle in FIG. 1.
Figure 3:
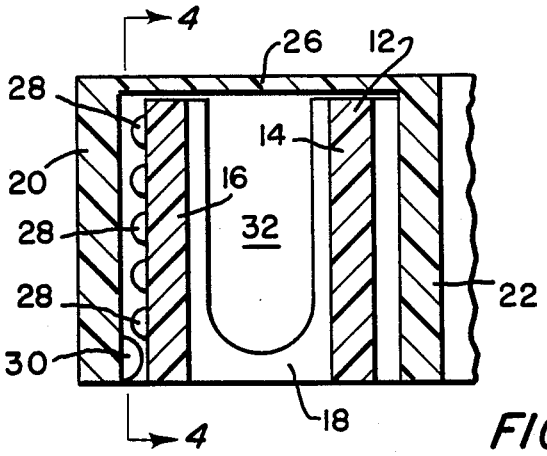
FIG. 3 is a cross-sectional view taken along section 3—3 of FIG. 1.
Figure 4:
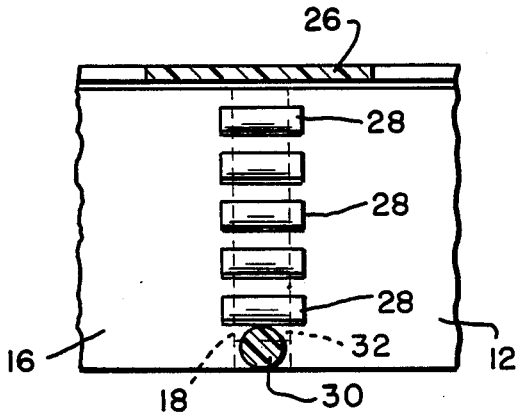
FIG. 4 is a cross-sectional view taken along section 4—4 of FIG. 3.

As shown in the figures, the novel form for a mortar cap 10 comprises a base frame 12 having a pair of concentric, spaced-apart walls 14 and 16, and a plurality -- eight, in this embodiment -- of ligaments 18 joining the walls 14 and 16, and fixing them together in their spaced-apart disposition. In addition, the form 10 comprises an ancillary frame 20 which also has a pair of concentric, spaced-apart walls 22 and 24, and a plurality -- four in this embodiment -- of limbs 26 joining these walls and fixing them together as well.

The limbs 26 bridge across the top of the ancillary frame 20, whereas the ligaments 18 traverse across the base frame 12. The base frame is set within the ancillary frame 20, and the latter is slidably engaged with the base frame, and vertically displaceable relative to the base frame 12. In a plurality of locations, whereat the ligaments 18 are located, the base frame 12 has a plurality of racks of ribs 28 which are arrayed on the surface of wall 16 which confronts the wall 24 of the ancillary frame 20. At the bottom of wall 20, which confronts the wall 24 of the ancillary frame, are hemispheric knobs 30. The latter knobs 30 are the same in number as the racks of ribs 28.

When the ancillary frame 20 is raised, relative to the base frame 12, the knobs 30 and ribs 28 interfere with each other, so that it is necessary to force the knobs 30 past each rib 28 in turn -- depending upon how much it is desired to elevate the ancillary frame 20. At the desired elevation, the knobs 30 come to rest between a pair of ribs 28 and, consequently, the ancillary frame is arrested at such elevation.

Not infrequently, it is necessary to accommodate a manhole frame at an angle, as at the side slope of a roadway, or at an inclining or declining pavement. With no complication, the instant form 10 provides for this with facility. One has only to raise a sector, i.e., a side, of the ancillary frame 20, leaving the other side (or sector) of the frame 20 set fully down on the base frame 12, and the form is prepared to receive cementitious materials therein and define a sloped or angled mortar cap. Therefore, whether it is necessary to provide a sloped mortar cap, or to define a raised mortar cap (due to a resurfacing of roadway or pavement), the novel form is equal to the matter.

As shown, each of the ligaments 18 have openings 32 formed therein to allow cementitious materials to flow therethrough and fill the channel formed by the walls 14 and 16. The materials are allowed to flow into and through the form 10 wherever it will, and set up. Then, the manhole frame (not shown) may be set thereupon. The materials may be trowled level with the limbs 26, and the whole assemblage left in place for the manhole frame, or the ancillary frame 20 may be removed and discarded; studs for mounting of the manhole frame may be emplaced, protrudingly, in the channel formed by the walls 14 and 16. These are options of use for the novel form 10 which are not germane to this disclosure.

While I have described my invention in connection with a specific embodiment thereof, it is to be clearly understood that this is done only by way of example and not as a limitation to the scope of my invention as set forth in the objects thereof and in the appended claims.

I claim:

1. A form for a mortar cap, for receiving cementitious materials therewithin, said form comprising:

a base frame;

said frame having a pair of concentric, spaced-apart walls defining a space therebetween; and an ancillary frame;

said ancillary frame also having a pair of concentric, spaced-apart walls defining a space therebetween; wherein said base frame is set within said space of said ancillary frame;

said ancillary frame is slidably and vertically displaceable relative to said base frame;

said ancillary frame has a plurality of limbs joining said walls thereof, and fixing said walls thereof in said spaced-apart disposition;

said ancillary frame has a bottom and a top; and said limbs bridge between said walls of said ancillary frame across said top thereof.

2. A form for a mortar cap, according to claim 1, wherein:

said base frame has a plurality of ligaments joining said walls thereof, and fixing said walls thereof in said spaced-apart disposition.

3. A form for a mortar cap, according to claim 2, wherein:

said ligaments have openings formed therein to accommodate a flow therethrough of cementitious materials.

4. A form for a mortar cap, for receiving cementitious materials therewithin, said form comprising:

a base frame;

said frame having a pair of concentric, spaced-apart walls defining a space therebetween; and an ancillary frame;

said ancillary frame also having a pair of concentric, spaced-apart walls defining a space therebetween; wherein said base frame is set within said space of said ancillary frame;

said ancillary frame is slidably and vertically displaceable relative to said base frame;

said walls of said base frame and said walls of said ancillary frame have mutually confronting respective outer and inner surfaces; and means disposed on an inner surface of said ancillary frame and a mutually confronting outer surface of said base frame for arresting said ancillary frame at selected, vertical displacements thereof relative to said base frame.

5. A form for a mortar cap, according to claim 4, wherein:

said ancillary frame has a plurality of limbs joining said walls thereof, and fixing said walls thereof in said spaced-apart disposition.

6. A form for a mortar cap, according to claim 4, wherein:

said arresting means comprises means cooperative for arresting a sector of said ancillary frame at selected, vertical displacements thereof relative to said base frame.

7. A form for a mortar cap, for receiving cementitious materials therewithin, said form comprising:

a base frame;

said frame having a pair of concentric, spaced-apart walls defining a space therebetween; and an ancillary frame;

said ancillary frame also having a pair of concentric, spaced-apart walls defining a space therebetween; wherein said base frame is set within said space of said ancillary frame;

said ancillary frame is slidably and vertically displaceable relative to said base frame;

said frames have means cooperative for arresting said ancillary frame at selected, vertical displacements thereof relative to said base frame; and said arresting means comprises at least one knob projecting from at least one wall of said ancillary frame, and ribs projecting from at least one of said base frame.

* * * * *